United States Patent [19]

Richard

[11] 4,113,510

[45] Sep. 12, 1978

[54] PROCESS FOR REGENERATING FOUNDRY SAND

[75] Inventor: Gérard Yves Richard, Precy sur Oise, France

[73] Assignee: Societe d'Applications de Procedes Industriels et Chimiques S.A.P.I.C., Asnieres, France

[21] Appl. No.: 730,829

[22] Filed: Oct. 8, 1976

Related U.S. Application Data

[63] Continuation of Ser. No. 582,657, Jun. 2, 1975, abandoned.

[30] Foreign Application Priority Data

Jun. 7, 1974 [FR] France ..... 74 19781

[51] Int. Cl.[2] ..... B08B 3/08

[52] U.S. Cl. ..... 134/2; 134/25 R; 134/27; 134/29; 134/38; 134/39; 164/5

[58] Field of Search ..... 134/2, 3, 25 R, 26, 134/28, 29, 38, 39, 27, 20; 164/5; 252/95, 100, 101

[56] References Cited

U.S. PATENT DOCUMENTS

| | | | |
|---|---|---|---|
| 962,265 | 6/1910 | Smith | 164/5 X |
| 2,666,001 | 1/1954 | Marshall | 134/3 UX |
| 2,766,496 | 10/1956 | Ward | 164/5 X |
| 2,882,237 | 4/1959 | Mahoney | 134/39 X |
| 3,168,477 | 2/1965 | Swanson et al. | 134/38 X |
| 3,654,940 | 4/1972 | Ritzi | 134/38 X |
| 3,694,264 | 9/1972 | Weinland et al. | 134/2 X |
| 3,787,239 | 1/1974 | Schroeder et al. | 134/2 |
| 3,796,601 | 3/1974 | Kindron et al. | 134/2 |
| 3,871,438 | 3/1975 | Vissers et al. | 164/5 |

*Primary Examiner*—Richard V. Fisher
*Assistant Examiner*—Marc L. Caroff
*Attorney, Agent, or Firm*—Keil, Thompson & Shurtleff

[57] ABSTRACT

Foundry sand particles are regenerated by contact with a liquid containing either a peroxide oxidant or an oxidizing salt to remove resinous binder material accumulated around each of the particles.

7 Claims, No Drawings

PROCESS FOR REGENERATING FOUNDRY SAND

This is a continuation of application Ser. No. 582,657, filed June 2, 1975, now abandoned.

The present invention is concerned with a process and apparatus for the regeneration or reclaimation of a granular material bound by resins and particularly for the regeneration of foundry sands agglomerated by means of an organic binder.

It is known in the foundry art to manufacture molds and cores of sand by mixing inert materials such as sand, the particles of which are agglomerated by an organic or mineral binder usually a resin, the setting of which is assured by a hardening additive.

Unfortunately the binder, particularly if it is organic, is transformed into carbon under the influence of heat of the parts cast in the sand mold or around the sand core. When the sand is re-utilized the carbon containing layer of binder interferes with a new agglomeration by preventing normal binding by the new quantity of binder added to the original charge for re-use. The binding of the particles takes place imperfectly, the mechanical characteristics conferred on the mold or the core are adversely affected by the manufacture with a sand previously used, and the net result is inferior to that obtained with a new sand.

In order to eliminate all or part of the resinous material accumulated around the particles of the charge, different processes of regeneration are usually recommended, namely, regeneration by calcination which is not too practical and very costly, and regeneration by grinding and cleaning mechanically and pneumatically which is largely utilized due to its low net cost.

A process is known in the art for regeneration by cleaning which, in its preferred form, involves calcination but is inconvenient and not particularly efficient.

The inferior mechanical characteristics of molds and cores manufactured from old sand may be due equally to residual acidity of the sand caused by acid used to harden the resin binder. The residual pH, varying between 2 and 3.5, is too low and causes spontaneous prepolymerization which is not only prejudicial to the mechanical characteristics but also considerably reduces the life of the old reutilized and bound sand.

As a practical matter in the two aforementioned cases, residual acidity of the sand and the presence of carbon particles in the resin are almost always involved in various degrees and are responsible for limitations in the reutilization of regenerated sands.

The present invention has for an object the overcoming of the aforesaid disadvantages by a process which (a) eliminates completely the accumulated resinous matter around the particles of the material, and (b) alters the acidity of the regenerated material to a value such that spontaneous polymerization does not occur. The aforesaid two-fold effect is accomplished by chemical means with ordinary compounds, the low net cost makes it advantageous, and the work accomplished in any case with a minimum usage of common labor.

Another object of the present invention is to provide a process for regeneration by chemical means of a granular material bound by resins characterized by the fact that the granular charge is submitted to a treatment comprising a reaction phase with oxidizing means and/or a neutralization phase.

In the preferred method of operation, the particles of the material are treated in one reaction phase by oxidizing means and in a neutralization phase, the two phases taking place successively, simultaneously or in combination. When the two aforesaid phases are simultaneous or combined, the particles of the material are subjected to chemical action in the same body. Regardless of whether the granular material is treated with an oxidizing acid, with a base and/or an alkaline salt, preferably an oxidizing salt, or a peroxide, which is preferably alkaline, the oxidizing compound for treating the granular material is selected from compounds which are active in the cold or at low or moderate temperatures.

The present invention also has for an object regeneration apparatus for carrying out the aforesaid process, the said apparatus comprising at a point somewhere in its system a continuous or discontinuous mixer permitting treatment of the material by chemical means, regardless of the quantity of oxidizing compound and neutralizing agent, the said apparatus preferably comprising a system for regulating temperature with or without heating to provide treatment in a uniform manner.

Various ways of carrying out the invention are hereinafter given by way of examples which are purely illustrative and not limitative.

First of all it is desirable to eliminate the residual acidity of agglomerate sands due to the acid hardener in the resin. For this purpose the recovered sand is partially neutralized in such a way as to form a buffer ("tampon") with the aid of a base or an alkaline salt. It will be understood that due to the fact that the recovered sand will ultimately be agglomerated by a resin containing a hardening acid, it is essential that the pH after neutralization not be too high so that it will interfere with the action of hardening acids of organic resins such as, for example, furanes, urea formaldehyde, phenolic, modified or unmodified furfural alcohol, alkyd resins or phenolic resins modified by an isocyanate. For a simple partial neutralization, without chemically attacking the covered particle of each grain of sand the majority of bases and alkaline salts give satisfactory results and particular mention may be made of disodium and trisodium phosphate, sodium aluminate, borax and sodium and potassium carbonate.

In the treatment involving chemical attack by oxidizing means of the particles of organic binder covering each grain of sand, different solutions are acceptable according to whether such treatment is separate or combined with the partial neutralization.

In practice, all oxidizing acids and salts are suitable and are effective in destroying the film of organic binder encapsulating the grains of sand. It is evident nevertheless that among the oxidizing compounds those which are more particularly selected are those which are effective in the cold or at low or moderate temperatures, thereby avoiding the necessity to supply heat and making the process more economical.

Peroxide acids, oxidizing acids such as chromic acid or nitric acid give complete satisfaction in attacking the organic pellicle of sand. These compounds, nevertheless, are less desirable in augmenting the acidity of the sand rather than reducing it, so that it is usually necessary to provide a double treatment: first an oxidizing attack by the acid or peroxide and then a partial neutralization, a method which, it will be understood, is longer and more costly and which should be substituted, if possible by a method which requires only a single treatment by action of a single compound.

Generally, the attack of the layer of organic material combined with partial neutralization of the sand is easily obtained by action of an oxidizing salt of an alkaline nature or also by action of an organic or mineral alkaline peroxide. For this purpose it is possible to cite as examples, but not by way of limitation: potassium perchlorate, potassium dichromate, lead chromate, lead oxide, manganese dioxide, bleaching water, ammonium perchlorate, potassium nitrate, ammonium dichromate, potassium permanganate, nitrobenzene, sodium vanadate, sodium metavanadate, sodium molybdate, sodium tungstate, the titanate of dipropyl di-triethanolamine, n-propyl tannate, sodium chlorate, sodium chlorite, potassium chlorate, benzoyl peroxide, peroxide of methylethyl ketone, sodium perborate, sodium percarbonate, and sodium persulfate.

In general, the choice of the oxidizing salt or the alkaline peroxide depends on the temperature of the sand after removal of the pieces and its quantity depends on the ratio between the weight of the sand and the weight of the molded or cast piece. In fact, the greater the amount of sand employed for molding a part, the greater the quantity of unburnt organic material and consequently the greater must be the amount of oxidizing salt or alkaline peroxide for treating it. In practice, the addition of the alkaline oxidizing salt or alkaline peroxide comprises, like the addition of oxidizing acid, base or alkaline salt, between 0.01 and 3% of active material based on the weight of sand being treated.

The invention will be further illustrated but is not limited by the following examples.

EXAMPLE I

Neutralization Phase Only

The regenerated sand having a residual significant acidity (pH 2.5) is treated with a solution of sodium diphosphate.

When the time of utilization of the sand not tamped is less than 2 minutes, which is too short for large moldings, the time of utilization, i.e., the time of the life of the regenerated sand before polymerization, is extended to 6 minutes after neutralization by disodiumphosphate.

The neutralization treatment, without oxidizing treatment, is carried out in the cold or in the warm, without difference, nor time of residence.

EXAMPLE II

Attack Phase by Single Oxidizing Means

The regenerated sand is treated cold with 2% by weight of sand of a solution of $CrO_3$ containing 50% of $CrO_3$. After residence time of several hours, the sand is agglomerated with 1% by weight of furane resin based on the weight of the sand.

The flexural resistance (bending strength) which was 11Kg/cm$^2$ for the sand not treated with $CrO_3$ became 17 Kg/cm$^2$ for the treated sand.

EXAMPLE III

Combined Treatment of Neutralization and Attack by Oxidizing Means

Regenerated sand having a temperature of 450° C. is treated with a solution of sodium meta vanadate containing 1% by weight of active material. After this treatment the sand is allowed to cool and is agglomerated with 1% by weight of a furane resin.

The flexural resistance was 17 Kg/cm$^2$ for the untreated sand and 29 Kg/cm$^2$ for the sand treated with the sodium meta vanadate.

EXAMPLE IV

Combined Treatment of Neutralization and Attack by Oxidizing Means

Regenerated sand having a mean temperature of 250° C. is treated with a solution of methyl ethyl ketone peroxide containing 10% by weight of active oxygen, then with a solution of borax. After this treatment the cooled sand is agglomerated with a phenol formaldehyde furfuryl alcohol modified resin at 1% by weight of the sand.

The flexural resistance was 14 Kg/cm$^2$ for the untreated sand and 24 Kg/cm$^2$ for the treated sand.

EXAMPLE V

Combined Neutralization and Oxidation Treatment

Regenerated sand having a mean temperature of 120° C. is treated with a solution of sodium chlorate containing 40% by weight of solids. After this treatment the cooled sand is agglomerated with a urea-formaldehyde phenolic furfuryl alcohol modified resin in the amount of 1% by weight.

The flexural resistance was 22 Kg/cm$^2$ for the untreated sand and 36 Kg/cm$^2$ for the treated sand.

EXAMPLE VI

The sand of Example V is treated at ambient temperatures. This sand gives under the same agglomerating conditions the same mechanical characteristics but in this case a time of contact between the regenerated sand and the sodium chlorate is necessary and it must remain about 3 hours before re-agglomerating the sand.

EXAMPLE VII

Combined Neutralization and Oxidizing Attack

The regenerated sand of Example V which had been submitted to attack by oxidation as well as partial neutralization by the alkalinity of sodium chlorate having formed a buffer (tampon) in situ, extends its effective life time, i.e., its time of utilization, thanks to treatment by the sodium chlorate to 4 minutes as compared to only 90 seconds without treatment.

EXAMPLE VIII

Combined Neutralization and Oxidizing Treatment

Sand agglomerated by phenolic/isocyannate resin system is treated with a solution of methyl ethyl ketone peroxide containing 10% by weight of active oxygen.

After a time of attack of several hours this sand is again agglomerated with 1% by weight of phenolic/isocyannate binder.

The flexural resistance which is 25 Kg/cm$^2$ for the untreated sand exceeds 38 Kg/cm$^2$ for the sand treated with the peroxide.

EXAMPLE IX

Combined Neutralization and Oxidizing Treatment

Regenerated sand at 100° C. previously cleaned mechanically and pneumatically is treated with a solution of hydrogen peroxide containing 50% by weight $H_2O_2$, then neutralized with a solution of sodium diphosphate.

After this treatment the cooled sand is agglomerated with a furane/formaldehyde resin at a content of 1% by weight.

The flexural resistance was 22 $Kg/cm^2$ for the untreated sand and 42 $Kg/cm^2$ for the treated sand.

It will be understood that the regeneration process of the invention applies to sands bound to synthetic resins, i.e., it is concerned with the treatment of raw or crude charges of sand as well as charges of sand, and which have been submitted to mechanical and pneumatic cleaning in order to reduce the layer of organic material surrounding the particles of sand.

In operating in accordance with the invention all material separated or integrated is processed in an apparatus for regeneration of the sand comprising at some point in the system, for example, a continuous or discontinuous mixer permitting the treatment of the sand by chemical means whether by an oxidizing compound or by a neutralizing compound. The apparatus, especially the mixer, must easily receive, if necessary, temperature regulation with or without heating to provide the quality of treatment in a uniform manner. The mixing may be replaced by any system of spraying or atomization of the oxidant or of the neutralizing compound at a judiciously chosen point in the apparatus.

The invention naturally is not limited to a specific mode of application, nor to the methods of accomplishments which have been mentioned. Variations may be made without departing from the spirit of the invention when the treatment comprises chemical means whether in a neutralization phase or an oxidizing attack phase or the two combined, or the two successively, or a combined treatment preceding or following neutralization or oxidizing phase.

The invention is hereby claimed as follows:

1. In a process for reclaiming a granular material in the form of particles of foundry sand which had been used for molds or cores and were bound by resins, in order to eliminate a pellicle of resinous binder material accumulated around each of the particles for reconstituting the characteristics of the granular material, the improvement comprising subjecting said particles to a chemical oxidizing treatment effective to oxidize said resinous binder pellicle with or without a chemical neutralization treatment by contacting said particles with a liquid containing, for said oxidizing treatment, a peroxide oxidant, the amount of said oxidant and the time of said chemical oxidizing treatment being sufficient to remove said pellicles of resinous binder about said particles, and, for the neutralization treatment, by contacting said particles with the same or a different liquid containing a base or an alkaline salt.

2. A process according to claim 1 wherein said peroxide oxidant is an alkaline peroxide.

3. A process as claimed in claim 1 wherein the peroxide is hydrogen peroxide.

4. In a process for reclaiming a granular material in the form of particles of foundry sand which had been used for molds or cores and were bound by resins, in order to eliminate the pellicle of resinous binder material accumulated around each of the particles for reconstituting the characteristics of the granular material, the improvement comprising subjecting said particles to a chemical oxidizing treatment effective to oxidize said resinous binder pellicle with or without a chemical neutralization treatment by contacting said particles with a liquid containing, for said oxidizing treatment, an oxidant selected from the group consisting of potassium perchlorate, potassium dichromate, lead chromate, lead oxide, manganese dioxide, ammonium perchlorate, potassium nitrate, ammonium dichromate, potassium permanganate, nitrobenzene, sodium vanadate, sodium meta vanadate, sodium molybdate, sodium tungstate, titanate of dipropyl ditriethanolamine, n-propyl tannate, sodium chlorate, sodium chlorite, potassium chlorate, sodium perborate, sodium percarbonate, and sodium persulfate, the amount of said oxidant and the time of said chemical oxidizing treatment being sufficient to remove said pellicles of resinous binder about said particles, and, for the neutralization treatment, by contacting said particles with the same or a different liquid containing a base or an alkaline salt.

5. A process as claimed in claim 4 carried out with a neutralization treatment in which the alkaline compound is a member selected from the group consisting of disodium phosphate, trisodium phosphate, sodium aluminate, sodium carbonate, potassium carbonate and borax.

6. A process as claimed in claim 1 carried out with a neutralization treatment in which the alkaline compound is a member selected from the group consisting of disodium phosphate, trisodium phosphate, sodium aluminate, sodium carbonate, potassium carbonate and borax.

7. A process as claimed in claim 1 wherein said peroxide oxidant is a member selected from the group consisting of benzoyl peroxide and methyl ethyl ketone peroxide.

* * * * *